United States Patent [19]

Knowles

[11] Patent Number: 4,687,370

[45] Date of Patent: Aug. 18, 1987

[54] REMOVABLE SPEEDBUMP-COVER

[76] Inventor: Larry F. Knowles, 835 Milwood Ave., Venice, Calif. 90292

[21] Appl. No.: 934,204

[22] Filed: Nov. 24, 1986

[51] Int. Cl.[4] ..... E01F 13/00

[52] U.S. Cl. ..... 404/15; 404/7; 404/10; 404/47; 52/396; 52/469

[58] Field of Search ..... 404/6, 7, 9, 10, 12, 404/15, 16, 47, 54, 68, 69; 256/1, 13.1; 52/396, 403, 465, 469, 471, 472, 573

[56] References Cited

U.S. PATENT DOCUMENTS

| | | | |
|---|---|---|---|
| 1,599,975 | 9/1926 | Peterson | 404/15 X |
| 1,688,409 | 10/1928 | Campbell | 404/12 |
| 2,976,782 | 3/1961 | Thom | 404/47 |
| 3,065,680 | 11/1962 | Wiedman, Sr. | 404/6 X |
| 3,209,662 | 10/1965 | Morton | 404/6 |
| 4,012,156 | 3/1977 | Turner et al. | 404/15 |
| 4,142,814 | 3/1979 | Sanchez | 404/7 |
| 4,203,685 | 5/1980 | Sanchez | 404/6 |

FOREIGN PATENT DOCUMENTS

| | | | |
|---|---|---|---|
| 1185475 | 4/1985 | Canada | 404/6 |
| 2030197 | 4/1980 | United Kingdom | 404/15 |

*Primary Examiner*—Stephen J. Novosad
*Assistant Examiner*—John F. Letchford
*Attorney, Agent, or Firm*—Bruce A. Jagger

[57] ABSTRACT

A removable speedbump-cover comprising an elongated laterally arcuate panel which is designed to rest on its elongated edges on the surface of a driveway. Gusset plates extend transversely of the panel on its concave side. The lower edges of the gusset plates are spaced slightly from the surface of the driveway so as not to interfere with the mounting of the panel. The panel is sufficiently flexible to permit the lower edges of the gusset plate to come into contact with the surface under load.

11 Claims, 6 Drawing Figures

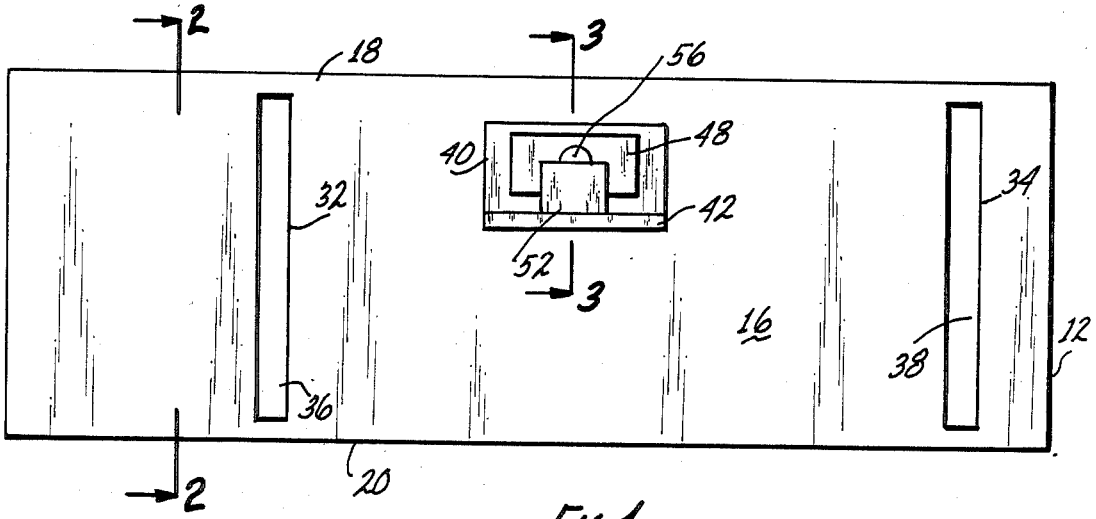
Fig. 1
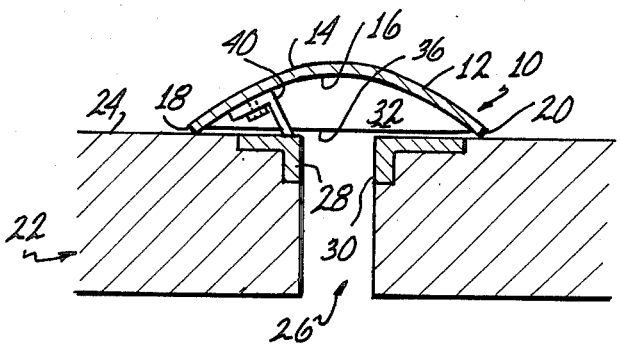
Fig. 2
Fig. 3
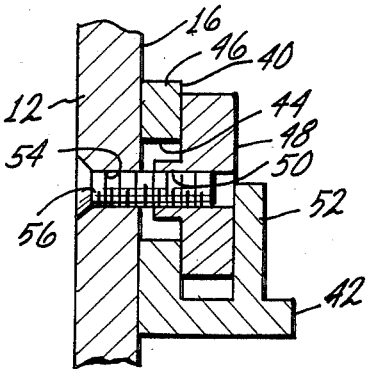

REMOVABLE SPEEDBUMP-COVER

The present invention relates to removable structures for mounting transversely on the surfaces of vehicular driveways. More particularly, the present invention relates to a removable combined speed bump and cover structure for use in vehicle driveways.

Previously considerable difficulty had been experienced in providing suitable covers for transverse openings in vehicular driveways and in installing means in such driveways to induce the drivers of the vehicles to drive slowly. Permanently mounted speed bumps constructed of concrete or asphalt have been utilized to reduce the speed of vehicular traffic. Expansion joints have generally been filled with a flexible sealant and left exposed to the vehicular traffic so as to facilitate repair of the flexible sealant when the joint develops a leak. Utility troughs which run transversely of driveway areas have generally been permanently sealed, which makes repair very difficult.

These and other difficulties of the prior art have been overcome according to the present invention by the provision of a removable speed bump, which may also serve as a cover for an expansion joint, a utility trough or the like. According to the present invention, a laterally arcuate elongated panel is provided, which presents a convex surface to the vehicular traffic and a concave surface to the driveway. Support means is provided in the concave side of the panel so as to support and distribute the vehicular loads which are applied to the convex side. The panel generally rests on its longitudinally extending elongated edges. The support means is spaced slightly from the surface of the driveway, so as to permit the panel to be applied to somewhat irregular driveway surfaces. Under load the panel flexes, so as to bring the normally lower edge of the support means into contact with the surface of the driveway. Means for removably mounting the elongated panel to the surface of the driveway is provided. The means for removably mounting preferably includes structural features which permits substantial tolerance between the driveway and the elongated panel. The member is so constructed that it flexes to accommodate both installation and use requirements. Irregularities in the driveway are thus accommodated in the mounting, as well as in the use of the panel.

Elongated panels, according to the present invention, are preferably formed from plate steel, which is rolled or otherwise shaped along its longitudinal axis, so as to provide the desired laterally arcuate configuration. The steel plate must preferably be held to a reasonable thickness, not exceeding approximately three-sixteenths to three-eighths of an inch in order to keep the weight, flexibility, workability and cost within acceptable limits.

When vehicular traffic passes over the convex side of the panel, it flexes and might be flattened, but for the provision of stiffening members, which serve both to hold the desired lateral arc of the panel and to spread the load over a larger area of the driveway surface. The stiffening members must, however, be positioned so as to permit the installation of the structure. Some irregularity inevitability occurs in the forming of the driveway surface. This irregularity must be accommodated so as to permit the panel to rest firmly on the driveway surface. It is very difficult to install the panel so that its lateral edges are flat against the surface of the driveway if the normally lower edges of the stiffening members are in, about or below the plane which is defined by the elongated edges. If the structure is not flexible enough to let the lower edges of the stiffening members touch the surface of the driveway when the panel is under load, then the entire load must be supported on the elongated edges alone and the panel may be flattened or the driveway surface damaged under the elongated edges. Where the elongated edges alone transmit the load from the panel to the driveway, those edges may tend to dig into and break the driveway surface.

Structural expansion joints which traverse driveways are frequently sealed with an elastomeric material, so as to prevent water from flowing through the expansion joint. The wear and tear of vehicular traffic passing over the expansion joint tends to damage the sealant, so as to require its early replacement. Covering an expansion joint with a removable elongated panel according to the invention protects the joint from wear and tear, provides a pocket for excess sealant to accumulate in, and permits easy renewal of the expansion joint when the sealant has exceeded its useful life.

The elongated removable panel of the present invention also finds utility when simply applied to a continuous driveway surface, so as to function as a speed bump. Speed bumps have previously been constructed of asphalt or concrete, for example. Such prior speed bumps were frequently formed on already existing surfaces. Various anchoring expedients were required in order to hold these prior speed bumps in place. At elevated temperatures such as are frequently encountered on a hot summer day, asphalt speed bumps tended to flow and deform under load. Concrete speed bumps did not adhere well to the surfaces of already existing driveways. Heavy vehicular traffic frequently caused concrete speed bumps to disintegrate and break loose from the driveway surface. The elongated panels, according to the present invention, are firmly anchored to the driveway surface through a releasable connection, which is preferably actuatable from the convex side of the panel. Thus, the panel is not only securely mounted but it can be removed to provide access to the area underneath it or to move it to a different location.

The ability of an elongated panel, according to the present invention, to reliably support loads despite irregularities in the driveway surface is provided by the cooperation of several features. In general, the stiffening of the panel is accomplished by providing gusset plates, which are inserted into, extend generally transversely of, and are rigidly attached to the concave side of the panel. The normally lowermost edge of these gusset plates is intended to be load bearing when in contact with the surface of the driveway. A slight spacing of the load-bearing edge of the gusset plate from the plane defined by the elongated edges of the panel, and, thus, from the surface of the driveway, permits the accommodation of substantial irregularities in the driveway surface, while at the same time providing support when the panel is loaded. In general, the gusset plates are spaced from approximately nine to twenty four inches apart when measured at the center line of the elongated arcuate panel and extended approximately normal to the longitudinal axis of the panel. If desired, the gusset plates may extend at an angle to the longitudinal axis of the panel. In any event, the gusset members extend generally transversely across the concave side of the panel. The generally transverse extension of the gusset members provides support across substantially the width of the panel and tends to stabilize the panel so that it does not rock laterally as traffic passes over it. The normally lower edge of the gusset plate is preferably spaced from one-sixteenth to one-quarter of an inch from the plane which is defined by the longitudinally extending edges of the panel.

The gusset plates are required to stiffen and support the panel. Forming a panel from, for example, plate steel which is thick enough so that it does not require gussets for stiffening and support is generally not practical. Such a thick panel would be very difficult to work with, both in the manufacturing and in the installation. It would generally not be sufficiently flexible to conform to the surface of the driveway. In general, a panel of the preferred thickness can be shaped by conventional equipment during manufacturing and can be handled at the job site without heavy equipment to move it. When secured in place, the fastening means can pull the somewhat flexible panel down so that it follows the contour of an irregular driveway surface. This brings both of the elongated edges of the panel into contact with the driveway surface along most or all of the length of the panel. When a heavy load is applied to the structure the panel flexes and permits the normally lower edges of the gusset elements to touch the driveway surface. The panel should be of a thickness which will permit such flexing during installation and use.

The elongated edges of the panel may be formed by the edges of the plate which forms the arcuate panel or by shoes or skid plates which are attached to the panel. The elongated edges are the parts of the speedbump-cover member which contact the surface of the driveway at the laterally remote parts of the structural member. The elongated edges of the panel may provide either line or area contact with the driveway.

The means which permits the speedbump-cover structure to be removably mounted to the driveway preferably incorporates some threaded fastener means because such fasteners are readily removed and reinstalled. Also threaded fasteners are well suited to drawing the panel down so that the elongated edges are in solid contact with the driveway surface. The present invention also contemplates various other fastening means, including even those which are designed to be released but are necessarily destroyed in the process.

The accompanying drawings are provided for the purposes of illustration only and not limitation.

In the drawings there is illustrated:

FIG. 1 is a bottom view of an elongated structural speedbump-cover member according to the present invention;

FIG. 2 is a cross-sectional view taken along line 2—2 in FIG. 1;

FIG. 3 is a cross-sectional view taken along line 3—3 in FIG. 1;

Figure 4:
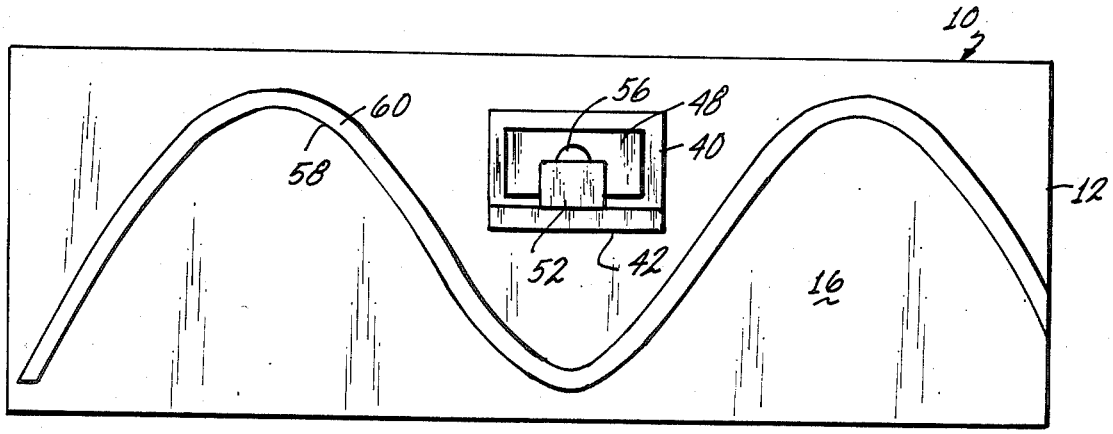
FIG. 4 is a view similar to FIG. 1 showing a further embodiment according to the present invention.

Referring particularly to the drawings, there is illustrated generally at 10 an elongated laterally arcuate structural speedbump-cover member according to the present invention which includes a laterally arcuate elongated panel 12. Elongated panel 12 includes an elongated convex side 14, an elongated concave side 16, a first elongated edge 18 and a second elongated edge 20.

Structural member 10 is adapted to be removably mounted to a driveway, which is indicated generally at 22. The structural member 10 rests on driveway surface 24. Driveway 22 includes an expansion joint indicated generally at 26. Joint 26 includes reinforcing edge members 28 and 30. Structural member 10 is adapted to be removably mounted bridging laterally over and longitudinally along joint 26 with convex side 14 normally uppermost. The concave side 16 defines a pocket positioned over joint 26 which serves to receive, protect and confine expansion joint sealant material (not illustrated). Gusset members 32 and 34 extend generally transversely of the concave side 16 of elongated panel 12. The normally lowermost edge of the gusset members is normally spaced slightly from the driveway surface 24 in the mounted configuration. The lowermost edge of the gusset members 32 and 34 provides support edges 36 and 38, which serve to support structural member 10 when it is loaded on convex side 14 to such an extent that panel 12 flexes and permits the support edges 36 and 38 to come into contact with the driveway surface 24. Support edges 38 and 36 may be formed so as to provide either line or area contact with the driveway surface. The positioning of support edges 36 and 38 so that they are normally out of contact with surface 24 makes it possible to install structural member 10 in areas where the driveway surface 24 is not exactly level and true. When installed, the structural member 10 preferably rests on elongated edges 18 and 20 of panel 12 for all or most of its length.

A generally L-shaped anchor member 40 is welded at foot 42 to reinforcing edge member 28. An enlarged hole 44 passes through leg 46 of anchor member 40. A floating nut 48 is positioned with a neck 50 in hole 44. The inside diameter of hole 44 is considerably larger than the outside diameter of neck 50. Cage member 52 holds floating nut 48 in operative position. A countersunk hole 54 is provided in panel 12 and is adapted to receive bolt 56. The floating nature of nut 48 permits some inaccuracy in the alignment of countersunk hole 54 and anchor member 40. Misalignment can be accommodated within the tolerance permitted by the difference in the diameters of enlarged hole 44 and neck 50. The threaded engagement between nut 48 and bolt 56 permits the panel to be drawn down snug to the surface of an irregular driveway during installation so that the longitudinal edges of the panel rest firmly on the surface. Being solidly supported by the irregular driveway surface without any opportunity for movement prevents the structural member from rocking or working itself loose from its mounting means. The panel is preferably attached to the driveway at a plurality of points. Anchor member 40 is preferably discontinuous so as to permit the installation of the gusset members and to further accommodate irregularities which may exist in either the driveway or the structural member.

Referring particularly to FIG. 4, an arcuate continuous gusset member 58 is illustrated, which extends generally transversely of elongated concave side 16 of panel 12. Continuous gusset member 58 is provided with a support edge 60 which is adapted to be spaced slightly from the surface of a driveway. The gusset member 58 is positioned on concave side 16 so as to pemit the positioning and installation of anchor member 40. Anchoring members are generally located every 6 to 15 inches along panel 12.

Figure 5:
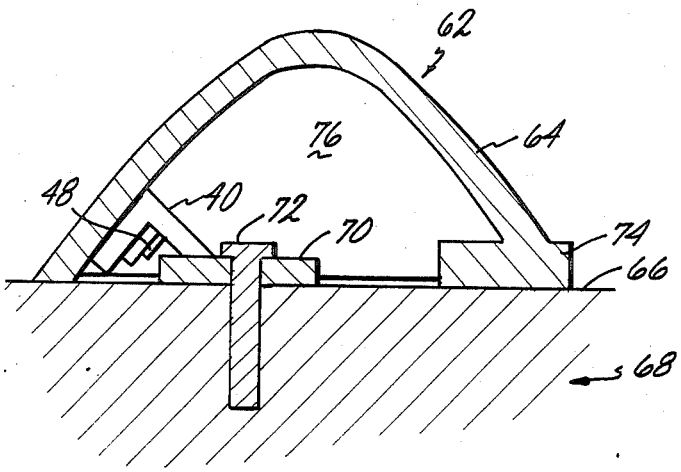
FIG. 5 is a cross-sectional view similar to FIG. 2 of an additional embodiment of the invention.

Referring particularly to FIG. 5, an elongated structural member is indicated generally at 62. Structural member 62 includes an elongated laterally arcuate panel 64. Structural member 62 is adapted to be mounted to the continuous surface 66 of a driveway. The driveway is indicated generally at 68. A plate 70 is anchored by means of fastener 72 to continuous surface 66 and anchor member 40 is welded to plate 70. Panel 64 is provided with a foot or skid plate 74 which rests on the surface 66, so as to distribute the load on the convex surface of panel 64 over a large area of surface 66. The bottom surface of panel 64 forms one of the elongated edges upon which the member 66 is intended to be supported. A gusset member 76 is provided to strengthen the panel 62 and to support the load on the convex side of panel 64. The normally downwardly facing edge of gusset member 76 is adapted to be spaced slightly from surface 66 of driveway 68 to provide clearance for mounting the structure to an irregular surface.

The embodiment illustrated particularly in FIG. 5 is suitable for use where particularly heavy vehicular traffic is encountered. The elongated edge of panel 64 which is formed by the bottom surface of skid plate 74 is well suited to the transmittal of very heavy loads from the convex side of panel 64 to the driveway surface 66.

Figure 6:
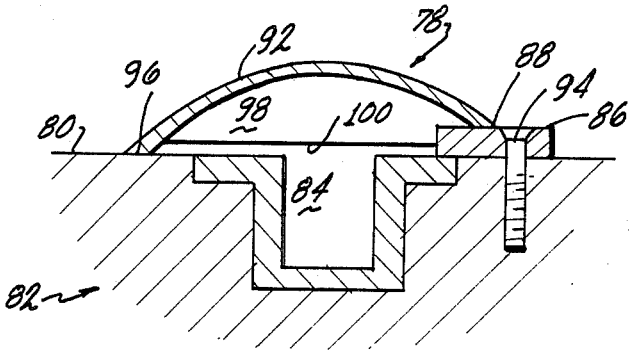
FIG. 6 is a cross-sectional view similar to FIG. 2 of an additional embodiment of the invention.

Referring particularly to FIG. 6, there is illustrated generally at 78 an elongated structural member mounted on the surface 80 of a driveway. The driveway is indicated generally at 82. Structural member 78 extends longitudinally of utility trough 84 and is laterally arcuate, so as to bridge over and cover utility trough 84. A mounting plate 86 is rigidly mounted to laterally arcuate panel 92 at 88. Fastener 94 secures mounting plate 86 to driveway 82. A plurality of such fasteners are provided along the length of member 78 at a spacing of from approximately 6 to 24 inches. The remote edge 96 of elongated arcuate panel 92 rests slideably on driveway surface 80. A gusset plate 98 extends generally transversely of the concave side of panel 92. The lower surface of mounting plate 86 defines the first elongated edge of panel 92 and the remote edge 96 provides the second elongated edge. The normally lower edge 100 of gusset 98 is spaced from the plane defined by the elongated edges of panel 92, so as to accommodate the installation of structural member 78 on a somewhat irregular driveway surface, as discussed above. A skid plate, such as is illustrated, for example, at 74 in FIG. 5, may be provided at the second elongated edge 96 if very heavy loads are anticipated. The bottom of such a skid plate then becomes the second elongated edge of panel 92.

Generally it is preferred to have the attachment point for the structural member between the two longitudinal edges so that tightening down on the fastening means tends to draw both edges down onto the surface of the driveway. The embodiment illustrated, for example, in FIG. 6 is easy to mount but the remote edge 96 may not be drawn into solid contact with the surface of the driveway when fastener 94 is drawn down to the maximum extent possible. If the remote edge of the panel is raised up off of the surface 80, heavy traffic passing over the panel exerts substantial forces on the fastener 94 because of the long leverage arm between the remote edge 96 and the fastener 94. Eventually the fastener may be broken or work loose because of such forces. There is less opportunity for this to occur where the panel is fastened between the elongated edges and both edges are drawn down firmly to the surface. If the panel is mounted between its elongated edges and both elongated edges are not drawn down firmly the panel may rock around the mounting point and eventually break loose.

In general, the elongated laterally arcuate panels, according to this invention, are from about six to fifteen inches and, preferably, about nine to twelve inches wide between their elongated edges. The normally uppermost point on the convex side is generally from approximately two inches to six inches above the plane which is defined by the respective elongated edges. The support edges of the gusset plates are generally from approximately one-sixteenth of an inch to one-quarter of an inch above and approximately parallel to the plane defined by the respective elongated edges of the panel. These support edges may be designed to provide either line or area contact with the driveway. When a skid plate or shoe is used at the elongated edges to distribute the weight over a larger area of the driveway surface, the shoe is generally preferably continuous and has a width of at least approximately one-half inch. The means by which the combined speedbump-cover of this invention is removably mounted to the driveway may be selected so as to meet the requirements of a particular situation.

The flexibility and design of the structure of the invention permits it to be fabricated without precisely controlling the dimensions and configuration of the structure. This substantially reduces the cost and difficulty of manufacturing this structure.

In use, the structure of the present invention is generally mounted adjacent to one elongated edge. The other elongated edge, whether provided with a skid plate or not, is free to slide along the surface of the driveway as the panel flexes in response to vehicular loads. The provision of structure which provides flexibility both in installation and in use contributes significantly to the invention.

When used with expansion joints, the structure of the present invention protects the sealant from the wear and tear of vehicular traffic and permits it to expand into the pocket defined by the concave side of the panel. Thus, on hot days the sealant may be squeezed out and up into the concave side of the panel without being damaged by vehicular traffic. On cold days when the structure has contracted, the sealant may retract entirely from the cavity defined by the concave side of the panel. Where the structure of the present invention is utilized to cover a utility trough, access to that trough is easily and quickly accomplished by removing the elongated laterally arcuate structural member of this invention. When the inspection or repairs are completed, the structure is easily reinstalled.

What have been described are preferred embodiments in which modifications and changes may be made without departing from spirit and scope of the accompanying claims.

What is claimed is:

1. An elongated structural member for mounting on a surface of a vehicular driveway transverse to the normal path of vehicular travel comprising:

a laterally arcuate elongated panel having an elongated convex side, an elongated concave side, a first elongated edge and a second elongated edge, said first and second edges being adapted to support said panel on said vehicular driveway, said convex side adapted to being positioned to be contacted by vehicular traffic passing over said driveway, and said concave side being adapted to be positioned facing the surface of said driveway;

means for supporting a load on the convex side of said panel including at least one gusset member extending generally transversely of said concave side, said gusset member terminating in a normally downwardly facing support edge, said gusset member normally extending from said concave side toward but not to a plane defined by said first and second edges so as to permit said panel to flex and to conform to an irregular driveway surface; and means for mounting said panel to said driveway including fastening means actuatable from said convex side for removably securing said panel to said driveway.

2. An elongated structural member of claim 1 wherein said means for mounting is adjacent to said first elongated edge and said second elongated edge being adapted to slideably contact an area of said driveway surface.

3. An elongated structural member of claim 1 including means for drawing said elongated edges down into firm contact with said surface.

4. An elongated structural member of claim 1 wherein said means for mounting includes an anchoring member adapted to be mounted to said driveway.

5. An elongated structural member of claim 4 wherein said anchoring member is adapted to be mounted to said driveway between said elongated edges.

6. An elongated structural member of claim 5 including means for accommodating misalignment between said panel and said anchoring member.

7. A cover for an elongated opening in a vehicular driveway, said elongated opening being of the type which includes elongated spaced apart first and second members to define a gap therebetween, said first member including a first normally uppermost edge which comprises a plate element, said cover comprising:

a laterally arcuate elongated panel having an elongated convex side, said panel being adapted to extend laterally across said gap and along said opening with said convex side normally uppermost, and to be slideably supported on said second member;

support means on an elongated concave side integral with said panel for reinforcing said panel against the weight of said vehicular traffic, said support means depending from said concave side and adapted to be normally slightly spaced from the surface of the driveway;

mounting means for attaching said panel to said plate element; and fastening means for removably securing said panel to said mounting means.

8. A cover of claim 7 wherein said opening is a structural expansion joint.

9. A cover of claim 7 wherein said opening is a utility trough.

10. A covered structural expansion joint in a vehicle driveway comprising:

elongated first and second joint members spaced apart to define a variable gap therebetween, said first joint member including a first normally uppermost edge which comprises an elongated metallic plate, said expansion joint being adapted to being sealed with a plastic sealant in said gap;

a laterally arcuate elongated panel having an elongated convex side, an elongated concave side, and first and second elongated edges, said panel extending laterally across said variable gap and along said expansion joint with said convex side normally uppermost and said concave side facing the surface of the driveway and defining a sealant receiving pocket normally above said variable gap, said panel being supported on the surface of said driveway on said first and second elongated edges, at least said second elongated edge being slideably supported on said second joint member;

means for removably mounting said panel to said metallic plate; and means for supporting a load on said convex side including at least one gusset member extending generally transversely of said concave side, said gusset member normally extending from said concave side toward but not to the surface of said driveway, said panel being sufficiently flexible under load to permit said gusset member to move down into contact with said surface so as to spread the load over a large area.

11. A removable raised structural member mounted transversely on a vehicle driveway comprising:

a laterally arcuate elongated panel having an elongated convex side, an elongated concave side, and first and second elongated edges, said panel extending laterally across said driveway with said convex side normally uppermost and said concave side facing the surface of the driveway above said attachment plate, said panel being supported on the surface of said driveway on said first and second elongated edges;

means for removably mounting said panel to said driveway; and means for supporting a load on said convex side including at least one gusset member extending generally transversely of and mounted to said concave side, said gusset member normally extending from said concave side toward but not to the surface of said driveway.

* * * * *